United States Patent [19]

Maclay

[11] Patent Number: 4,487,234

[45] Date of Patent: Dec. 11, 1984

[54] REINFORCED LOOM SHUTTLE AND METHOD

[75] Inventor: Robert E. Maclay, Taylors, S.C.

[73] Assignee: Steel Heddle Manufacturing Co., Greenville, S.C.

[21] Appl. No.: 365,549

[22] Filed: Apr. 5, 1982

[51] Int. Cl.[3] ..... D03J 5/02

[52] U.S. Cl. ..... 139/196.1

[58] Field of Search ..... 139/196.1, 196.2, 196.3, 139/196.4, 197, 212; 161/93, 94, 98

[56] References Cited

U.S. PATENT DOCUMENTS

| | | | |
|---|---|---|---|
| 2,771,100 | 11/1956 | Consoletti | 139/196.1 |
| 3,209,790 | 10/1965 | Naul | 139/196.1 |
| 3,660,219 | 5/1972 | Pugh et al. | 139/196.1 |

*Primary Examiner*—Henry S. Jaudon
*Attorney, Agent, or Firm*—Dority & Manning

[57] ABSTRACT

A fiber reinforced construction and method for a loom shuttle is disclosed which includes a plurality of layers 26, 28, 30 of a reinforcing fabric F laminated with conventional layers 18 across a section of the yarn eye slot E formed in the shed side wall 12 of the shuttle. The reinforcing fabric F includes reinforcing fibers, preferably Kevlar, woven in the filling direction which are oriented along the height of the side wall reinforcing the yarn eye section. The side wall is effectively reinforced against splitting caused by forces imparted by the actions of the picker stick and shuttle box on the loom.

9 Claims, 4 Drawing Figures

REINFORCED LOOM SHUTTLE AND METHOD

BACKGROUND OF THE INVENTION

The invention relates to a construction and method for a shuttle utilized on a shuttle loom to carry the filling yarn back and forth across the loom as fabric is woven. Typically, the shuttle is constructed from wood or other suitable material. During operation, the shuttle is accelerated back and forth across the width of the loom and fabric through a shed formed between the warp yarns by means of a picker stick which strikes the ends of the shuttle. Through this continuous action during operation, considerable forces are imparted to the shuttle.

Many constructions have been proposed for increasing the strength and life of the shuttle such as shown in U.S. Pat. Nos. 3,660,219 and 3,425,463. One of the more popular constructions presently used is a plastic laminated shuttle construction. Typically, the shuttle is cut from a block constructed from laminated layers of woven, unidirectional textile fabric impregnated with a phenolic resin. Most commonly, a conventional unidirectional cotton fabric, such as disclosed in U.S. Pat. No. 3,660,219 is utilized woven from cotton warp and fill yarns impregnated with a suitable phenolic resin and laminated in block form. The block is then cut out to have the desired form and bobbin chamber. In the final laminated construction, the warp yarns of the textile fabric run lengthwise in the shuttle, and the filling yarns run in the direction of the height of the side walls of the shuttle. The laminated layers between the outside surfaces of the side walls of the shuttle add rigidity where the shuttle undergoes much flexing (for example, see U.S. Pat. No. 3,215,764). Under compressive forces from the picker stick striking the ends of the shuttle, the side walls tend to bow out laterally and split due to tensile forces along the height of the side wall.

However, the problem occurs even in the prior reinforced constructions that the side wall on the shed side of the shuttle often splits in the area of the yarn eye slot which is cut out for passage and withdrawal of yarn during weaving. Since the forces are attenuated at the weak points of the shuttle construction, the side wall area adjacent the eye slot is highly susceptible to splitting and fatique failure.

Accordingly, an important object of the present invention is to provide a construction and method for reinforcing and extending the useful life of a loom shuttle.

Another important object of the present invention is to provide a loom shuttle which is resistant to splitting in the side wall on the shed side of the shuttle.

Yet another important object of the present invention is to provide a loom shuttle of laminated construction which includes selected layers of reinforcing fibers in the area of the yarn eye.

Still another important object of the present invention is to provide a laminated loom shuttle constructed of resin impregnated textile fabric layers wherein reinforcing layers are provided in a section of the yarn eye slot having reinforcing fibers extending vertically in the side wall resisting vertical wall separation.

SUMMARY OF THE INVENTION

The above objectives are accomplished according to the present invention by a laminated shuttle and method wherein layers of textile fabric woven from cotton yarns in the warp direction and Kevlar reinforcing fibers in the fill direction are located selectively in the side wall of the shuttle transversely across a section of the yarn eye slot. The Kevlar reinforcing fibers extend vertically along the height of the side wall. The reinforcing fibers provide increased tensile strength in the vertical direction in the side wall tending to prevent the side wall from splitting and separating vertically in the relatively weak area of the eye slot. The cottom yarns assure good adherence to the conventional fabric layers.

DESCRIPTION OF THE PREFERRED EMBODIMENT

Figure 1:
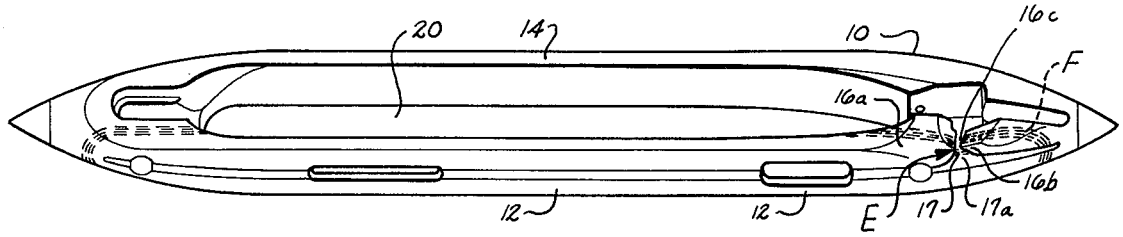
FIG. 1 is a side perspective illustrating a reinforced shuttle construction according to the invention.
Figure 2:
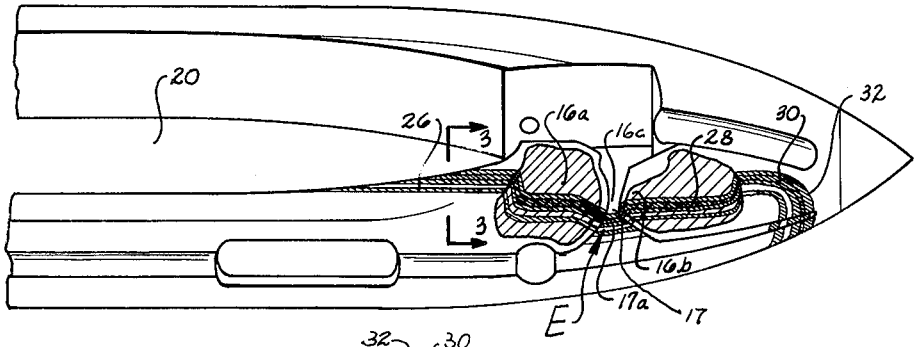
FIG. 2 is an enlarged partial view illustrating reinforcement in a section of the yarn eye slot of a shuttle according to the invention.
Figure 3:
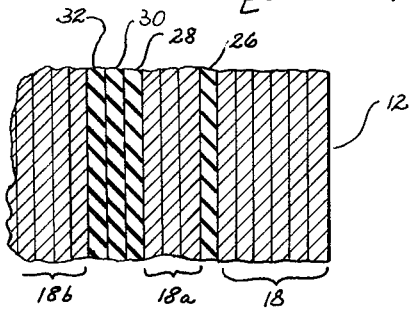
FIG. 3 is a section view taken along line 3—3 of FIG. 2.

The invention relates to laminated loom shuttle constructions and, more particularly, to a laminated construction in which the shuttle is reinforced in the side wall on the shed side of the shuttle in a section of the yarn eye slot through which yarn is withdrawn during weaving. Other grooves and cut-out may also be formed on the shed side of the shuttle for functional purposes.

Referring now in more detail to the drawings, a loom shuttle is illustrated at 10 which includes a pair of opposed side walls 12 and 14. A first side wall 12, which is the shed side of the shuttle as it faces the front shed during weaving, includes a yarn eye slot, designated generally at E, through which yarn from a bobbin (not shown) is guided and withdrawn during weaving. Eye slot E typically includes opposing beveled surfaces **16*a* and 16*b* narrowing to a thread gap 16*c* which opens into a widened yarn passage 17 having a bottom surface 17*a*** through which yarn is guided and withdrawn.

Shuttle 10 includes laminated layers 18 of conventional cotton fabric impregnated with phonelic resin having cotton yarns woven in the warp and fill directions. Typically, the entire shuttle is formed from laminated layers of cotton fabric impregnated with a phenolic resin and the block is cut out to provide a bobbin chamber 20 in which the bobbin is held. In wall 12, the yarn eye slot E is cut out for the yarn. Side wall 14 is the reed side facing the reed during beat-up and is normally solid except for a pair of bolt holes.

Figure 4:
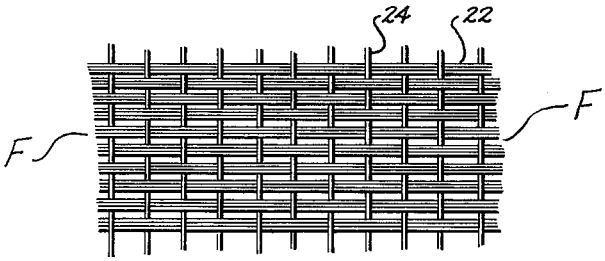
FIG. 4 is a schematic view of reinforcing fabric according to the invention.

According to the present invention, a plurality of cotton/Kevlar fabric layers are laminated in the side wall 12. The fabric F is illustrated schematically in FIG. 4 wherein the warps 22 include cotton yarns such as 10/2 English count and the filling 24 is a Kevlar fiber yarn such as 400/1 denier. A plurality of the cotton yarns may be included in each warp run 22. Preferably, a first layer 26 of cotton/Kevlar fabric is located approximately 3/16th of an inch from the edge of the side wall 12 inwardly followed by ⅛ inch of conventional cotton fabric layers **18*a*. Layers 28, 30, and 32 of cotton/Kevlar fabric are laminated together after the layers 18*a* of conventional cotton fabric at approximately 5/16 of an inch from the outside edge of wall 12 followed by layers 18***b* layers 18*b* of conventional cotton fabric which finish the side wall construction. As illustrated, the reinforcing layers 26, 28, 30, and 32 lie across a vertical section of the eye slot E reinforcing the tensile strength of side wall 12 in the area to reduce splitting of the side wall. While at least three layers of reinforcing fabric appear necessary, it has been found that four layers of Kevlar/cotton fabric provide good results without any unnecessary additional layers. The cotton warps 22 in reinforcing fabric F provide good bonding with the conventional cotton fabric layers found in the remaining construction.

Furthermore, it has been found that a fabric having ten picks per inch of Kevlar fiber yarns in the filling is adequate for suitable reinforcement in the eye slot section of the side wall 12. All of the fabric illustrated is unidirectional fabric in the laminated construction. Both the cotton/Kevlar fabric and the cotton/cotton fabric are illustrated in a plain weave pattern. While other synthetic fibers may also be satisfactorily used satisfactorily, such as polyester and nylon, in the reinforcing fabric F across the eye slot, these have not been tested. However, Kevlar has been found to be particularly suitable for the present application. The Kevlar reinforcing fibers may be continuous filament or staple fibers spun into the yarns or fibers which are then use to weave the fabric F. Kevlar brand of aramid fibers is a product of E. I. DuPont de Nemours & Co., Inc. of Wilmington, Del. from which such fibers and yarns are readily available.

Thus, it can be seen that an advantageous construction and method for a loom shuttle can be had according to the present invention wherein the side wall on the shed side of the shuttle is reinforced to reduce the likelihood of splitting where the forces are concentrated in yarn eye E. According to the present invention, the Kevlar fibers 24 in the reinforcing fabric F are oriented in the height or vertical direction of side wall 12 reinforcing its tensile strength as it is elongated as placed in tension by compressive forces exerted lengthwise on the side wall by the picker stick during acceleration of the shuttle to and fro across the loom during weaving.

While a preferred embodiment of the invention has been described using specific terms, such description is for illustrative purposes only, and it is to be understood that changes and variations may be made without departing from the spirit or scope of the following claims.

What is claimed is:

1. A loom shuttle of the type having first and second side walls constructed from conventional laminated layers of resin impregnated fabric a yarn eye slot formed in a first side wall of said shuttle through which yarn is guided and withdrawn during weaving wherein the improvement comprises:

a plurality of additional reinforcing layers of reinforcing fabric laminated with said conventional laminated layers of conventional fabric;

said additional reinforcing layers being included and oriented only in said first side wall laminated with said conventional laminated layers;

said second side wall including only said conventional laminated layers of resin impregnated fabric;

said additional reinforcing layers of reinforcing fabric including synthetic reinforcing fibers extending height wise in the direction of height of said first side wall having a strength greater than the corresponding fibers of said conventional layers; and said additional reinforcing layers being oriented across a section of said yarn eye slot in said first side wall with said height wise extending synthetic reinforcing fibers reinforcing the tensile strength of said first wall in the height direction of said side wall;

whereby splitting of said first side wall in the area of said eye slot is reduced.

2. The structure of claim 1 including:

a plurality of said conventional layers of conventional fabric commencing at an outside of said shed side wall;

a first of said reinforcing layers including said reinforcing fabric next to said plurality of conventional layers;

an intermediate layer of conventional fabric next to said first reinforcing layer;

a plurality of reinforcing layers of said reinforcing fabric adjacent said intermediate conventional layer;

a plurality of conventional layers of convention fabric laminated adjacent said plurality of reinforcing layers; and said plurality of reinforcing layers and intermediate conventional layers being laminated generally across a section of said yarn eye slot.

3. The structure of claim 1 or 2 wherein said reinforcing layers include woven fabric wherein said reinforcing fibers are included in the filling of said fabric and conventional fibers of said conventional layers are included in the warp direction of said woven fabric facilitating bonding with said conventional layers; and said woven reinforcing fabric is laminated in said first side wall with said filling of said fabric which includes said synthetic reinforcing fibers extending height wise in said side wall.

4. The structure of claim 3 wherein said convention fibers include cotton yarn.

5. The structure of claim 1 wherein said first side wall includes a plurality of said conventional layers laminated from an outside surface of said first side wall inwardly, a plurality of said reinforcing layers laminated across a section of said yarn eye slot in said first side wall, and an intermediate conventional layer laminated between adjacent ones of said reinforcing layers in said first side wall.

6. A method of reinforcing an eye slot section in a laminated shuttle of the type which includes first and second side walls having first laminated layers of resin impregnated fabric wherein an eye slot is formed in the first side wall of said shuttle, said method comprising:

including in said first side wall of said shuttle a plurality of additional layers of reinforcing fabric laminated in a section extending through said eye slot wherein the fabric includes synthetic reinforcing fibers; and including said additional layers of reinforcing fabric in said first side wall in addition to said first laminated layers of fabric in said first and second side walls so that said layers additional of reinforcing fabric laminated in said eye slot section are not included in said second side wall.

7. The method of claim 6 including orienting said reinforcing fibers in the height direction of said side wall.

8. The method of claim 6 wherein said reinforcing fibers include Kevlar fibers.

9. The method of claim 6 including laminating said reinforcing fabric wherein said reinforcing fibers extend in the height direction and cotton fibers included in said fabric extend in the lengthwise direction of said side wall.

* * * * *